US010013830B2

(12) United States Patent
Park

(10) Patent No.: US 10,013,830 B2
(45) Date of Patent: Jul. 3, 2018

(54) METHOD AND SMARTKEY SYSTEM FOR REDUCING BATTERY CONSUMPTION

(71) Applicant: HYUNDAI MOBIS CO., LTD., Seoul (KR)

(72) Inventor: Soo Min Park, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 1040 days.

(21) Appl. No.: 14/140,069

(22) Filed: Dec. 24, 2013

(65) Prior Publication Data

US 2014/0176304 A1 Jun. 26, 2014

(30) Foreign Application Priority Data

Dec. 26, 2012 (KR) ..... 10-2012-0153687

(51) Int. Cl.
*G07C 9/00* (2006.01)

(52) U.S. Cl.
CPC ..... *G07C 9/00309* (2013.01); *G07C 2009/00365* (2013.01); *G07C 2209/63* (2013.01)

(58) Field of Classification Search
CPC ..... G07C 9/00309
USPC ..... 340/5.61, 5.72; 455/41.2; 701/2; 320/103
See application file for complete search history.

(56) References Cited

U.S. PATENT DOCUMENTS 5,144,667 A * 9/1992 Pogue, Jr. ..... B60R 25/24 340/5.61
5,844,517 A * 12/1998 Lambropoulos ... G07C 9/00309 340/10.2
9,129,455 B2 * 9/2015 Mitchell ..... G07C 9/00309
2004/0024476 A1 * 2/2004 Takahashi ..... G07C 9/00309 700/65
2006/0202798 A1 * 9/2006 Baumgartner ..... B60R 25/2072 340/5.61
2007/0216517 A1 * 9/2007 Kurpinski ..... B60R 25/245 340/5.72
2008/0231417 A1 * 9/2008 Kurpinski ..... B60R 25/2036 340/5.72
2009/0267734 A1 * 10/2009 Kwon ..... B60R 25/2036 340/5.72
2010/0191392 A1 * 7/2010 Juzswik ..... B60R 25/245 701/2
2010/0231354 A1 * 9/2010 Nishiguchi ..... H04L 63/08 340/5.8
2014/0232322 A1 * 8/2014 Kracker ..... H02J 7/0054 320/103

* cited by examiner

*Primary Examiner* — Nabil Syed
(74) *Attorney, Agent, or Firm* — NSIP Law

(57) ABSTRACT

Provided is a smartkey system for reducing battery consumption. The smartkey system in a sleep mode wakes up at every certain interval, and first checks whether there is a fob near a vehicle. Only when there is the fob near the vehicle, the smartkey system receives authentication information from the fob to authenticate the fob. Therefore, an authentication operation is not performed when there is no fob near the vehicle, and thus, a wakeup time is shortened, thereby reducing an amount of dark current consumed by the vehicle. Moreover, the wakeup time of the smartkey system is shortened, thus securing a time margin that enables an additional operation to be performed in the sleep mode.

18 Claims, 12 Drawing Sheets

METHOD AND SMARTKEY SYSTEM FOR REDUCING BATTERY CONSUMPTION

CROSS-REFERENCE TO RELATED APPLICATIONS

This application claims priority under 35 U.S.C. § 119 to Korean Patent Application No. 10-2012-0153687, filed on Dec. 26, 2012, the disclosure of which is incorporated herein by reference in its entirety.

TECHNICAL FIELD

The present invention relates to a vehicle smartkey system, and more particularly, to a battery consumption reducing method of a vehicle smartkey system.

BACKGROUND

Generally, a smartkey system is a system that is built into a vehicle, and when a driver makes a desired action in a state of holding a smartkey, senses the action to control driving of the vehicle. The smartkey system includes a remote keyless (RKE) system and a passive keyless (PKE) system.

The PKE system is a system that remotely locks/unlocks a door of a vehicle even without holding a vehicle key. The PKE system is a system in which a driver or an owner of a vehicle locks/unlocks a door of the vehicle and starts the vehicle in a wireless manner at a position near the vehicle. Here, the smartkey is generally called a fob key, and is simply called a fob.

The vehicle smartkey system includes: a plurality of low frequency (LF) antennas that cover, as a communicable area, an indoor area of a vehicle and an outdoor area around the vehicle; a radio frequency (RF) antenna that receives an RF signal from a smartkey; and a smartkey electronic control unit (SMK ECU).

FIG. 1 is an exemplary diagram of a related art vehicle smartkey system. An SMK ECU of the vehicle smartkey system enters a warning mode after doors of a vehicle are locked. When a driver moves from the vehicle by a certain distance with the driver holding a fob, the SMK ECU switches a current vehicle mode to a sleep mode, folds side mirrors of the vehicle, and periodically starts WelcomeSearch. For the WelcomeSearch, the SMK ECU wakes up, and periodically (for example, at intervals of 240 ms) transmits wakeup data having a low frequency through an antenna that is attached to a driver door or an assistant door. The fob near the vehicle receives the transmitted wakeup data, and compares the wakeup data with data that is previously learned and stored. When it is determined that the wakeup data matches the learned data, the fob transmits RF data to the SMK ECU. The SMK ECU compares the RF data with the learned data, and when it is determined that the RF data matches the learned data, the SMK ECU releases the sleep mode of the vehicle smartkey system, turns on a puddle lamp, and folds the side mirrors.

The WelcomeSearch of the related art is performed in the sleep mode of the SMK ECU. As illustrated in FIG. 2, the SMK ECU wakes up at every interval of 240 ms, and performs the WelcomeSearch and PKE search. When there is no received data, the SMK ECU is again switched to the sleep mode. In performing the WelcomeSearch, when the fob responds or RKE data is received from the fob, the SMK ECU releases the sleep mode of the vehicle smartkey system, and simultaneously performs a requested operation.

In the existing method, the SMK ECU transmits an LF request, and when there are two fobs, in order for a malfunction not to be caused by data interference between the two fobs, the SMK ECU stands by for receiving all of RF data in a state where a section is divided into a plurality of sections. In providing an RF data response, each of the two fobs transmits the RF data in only its own section.

Subsequently, the SMK ECU determines whether the RF data received through an RF antenna matches a pre-stored identification number of the vehicle. When it is determined that the RF data matches the pre-stored identification number, the SMK ECU determines there to be a fob which has been found through the WelcomeSearch, and performs operations such as an operation of turning on the puddle lamp, an operation of unfolding the side mirrors, etc.

In the related art smartkey system, since the SMK ECU or an RF receiver periodically wakes up in the sleep mode, the WelcomeSearch needs a long time of a minimum of about 94 ms after LF data is transmitted, and considering noise and an RF tolerance, a time necessary for the WelcomeSearch more increases. Therefore, a dark current is greatly consumed, and an operation time is extended by reception standby that is performed due to an additional fob. Therefore, the dark current increases in proportion to the extended operation time. Also, considering the dark current or a time margin in a whole sleep mode, there is a limitation in task arrangement even in a case of applying new technology in which the SMK ECU operates in the sleep mode.

SUMMARY

Accordingly, the present invention provides a smartkey system that shortens an undesired wakeup time to reduce a dark current, thus reducing battery consumption.

In one general aspect, a smartkey system for reducing battery consumption includes: a communication unit configured to include at least one antenna for the smartkey system of a vehicle; a check unit configured to transmit a fob presence check signal to near the vehicle through the communication unit, and determine presence of the fob near the vehicle according to whether a presence signal, which is a response to the fob presence check signal, is received through the communication unit; an authentication unit configured to, when it is determined that the fob is near the vehicle, transmit an authentication information request signal through the communication unit, and when an authentication signal that is a response to the authentication information request signal is received, determine whether unique identifier information included in the received authentication signal matches predetermined unique identifier information of the vehicle; and a control unit configured to, when it is determined by the authentication unit that there is a match between the unique identifier information, release a sleep mode of the smartkey system.

The smartkey system may further include a storage unit configured to, when the presence signal is received, temporarily store the presence signal, wherein after the presence signal is temporarily stored, the authentication unit transmits the authentication information request signal to the fob that has transmitted the presence signal.

The check unit may first transmit the fob presence check signal through a first antenna of the communication unit, and after the presence signal that is a response to the fob presence check signal is temporarily stored, the check unit may transmit the fob presence check signal through a second antenna of the communication unit.

When the presence signal that is the response to the fob presence check signal transmitted through the first antenna is received through the communication unit, the authentication unit may first transmit the authentication information request signal through the first antenna, and when the unique identifier information included in the authentication signal received through the communication unit does not match the predetermined unique identifier information of the vehicle, in consideration of whether the presence signal is received through the communication unit, the authentication unit may transmit the authentication information request signal through the second antenna.

The communication unit may include a plurality of low frequency (LF) antennas and a radio frequency (RF) antenna, the first antenna may be an LF antenna of a driver seat side, and the second antenna may be an LF antenna of an assistant seat side.

Each of the fob presence check signal and the authentication information request signal, which are transmitted to the fob near the vehicle, may be a low frequency (LF) signal, and each of the presence signal and the authentication signal, which are received from the fob near the vehicle, may be a radio frequency (RF) signal.

The control unit may turn on a puddle lamp of the vehicle or unfolds side mirrors of the vehicle to release the sleep mode of the smartkey system.

Each of the fob presence check signal and the authentication information request signal may include some bits of predetermined vehicle identification (ID) information, and the authentication signal may include the other bits of the vehicle ID information.

The check unit may wake up the vehicle smartkey system at every certain interval, and may transmit the fob presence check signal through the communication unit to check presence of the fob near the vehicle.

The check unit may allocate a section for checking the presence signal according to number of registered fobs, and check presence of a corresponding fob for the allocated section according to whether the presence signal is received from the corresponding fob, in only the allocated section.

In another general aspect, a battery consumption reducing method of a smartkey system includes: determining whether a presence signal, which is a response to a fob presence check signal transmitted to near a vehicle, is received through an antenna for the smartkey system of the vehicle; when it is determined that the presence signal is received, transmitting an authentication information request signal to the fob that has transmitted the presence signal; when an authentication signal that is a response to the authentication information request signal is received, determining whether unique identifier information included in the authentication signal matches predetermined unique identifier information of the vehicle; and when it is determined that there is a match between the unique identifier information, releasing a sleep mode of the smartkey system.

Other features and aspects will be apparent from the following detailed description, the drawings, and the claims.

DETAILED DESCRIPTION OF EMBODIMENTS

Further aspects of the present invention described above will be clarified through the following embodiments described with reference to the accompanying drawings. Hereinafter, embodiments of the present invention will be described in detail in order for those skilled in the art to easily understand and reproduce the present invention through the embodiments.

Hereinafter, embodiments of the present invention will be described in detail with reference to the accompanying drawings.

Figure 1:
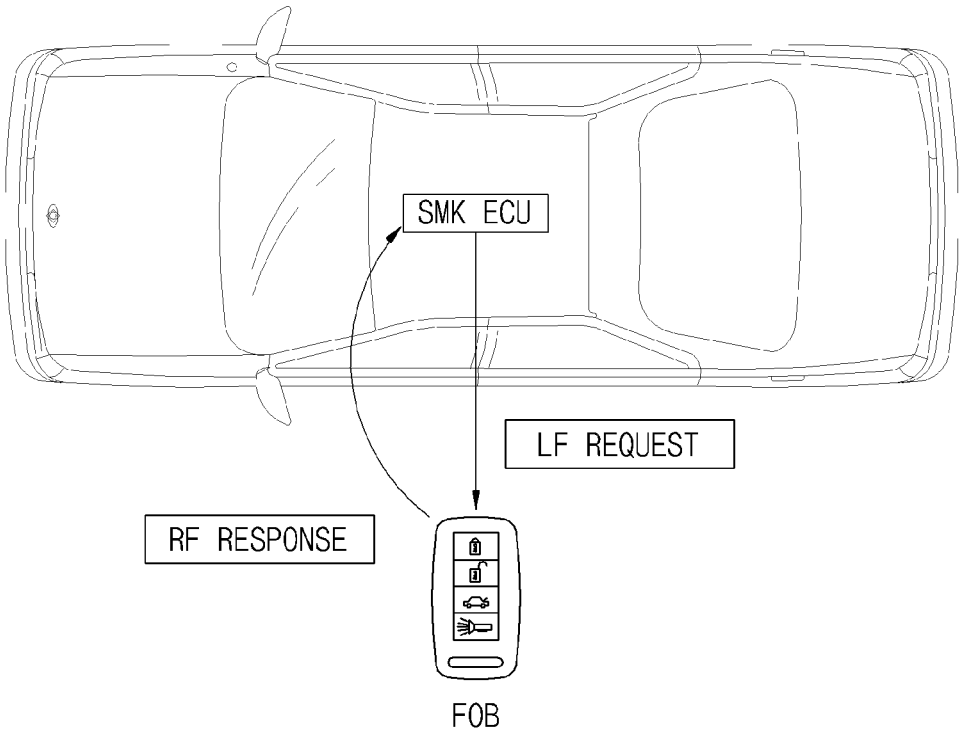
FIG. 1 is an exemplary diagram of a related art vehicle smartkey system.
Figure 2:
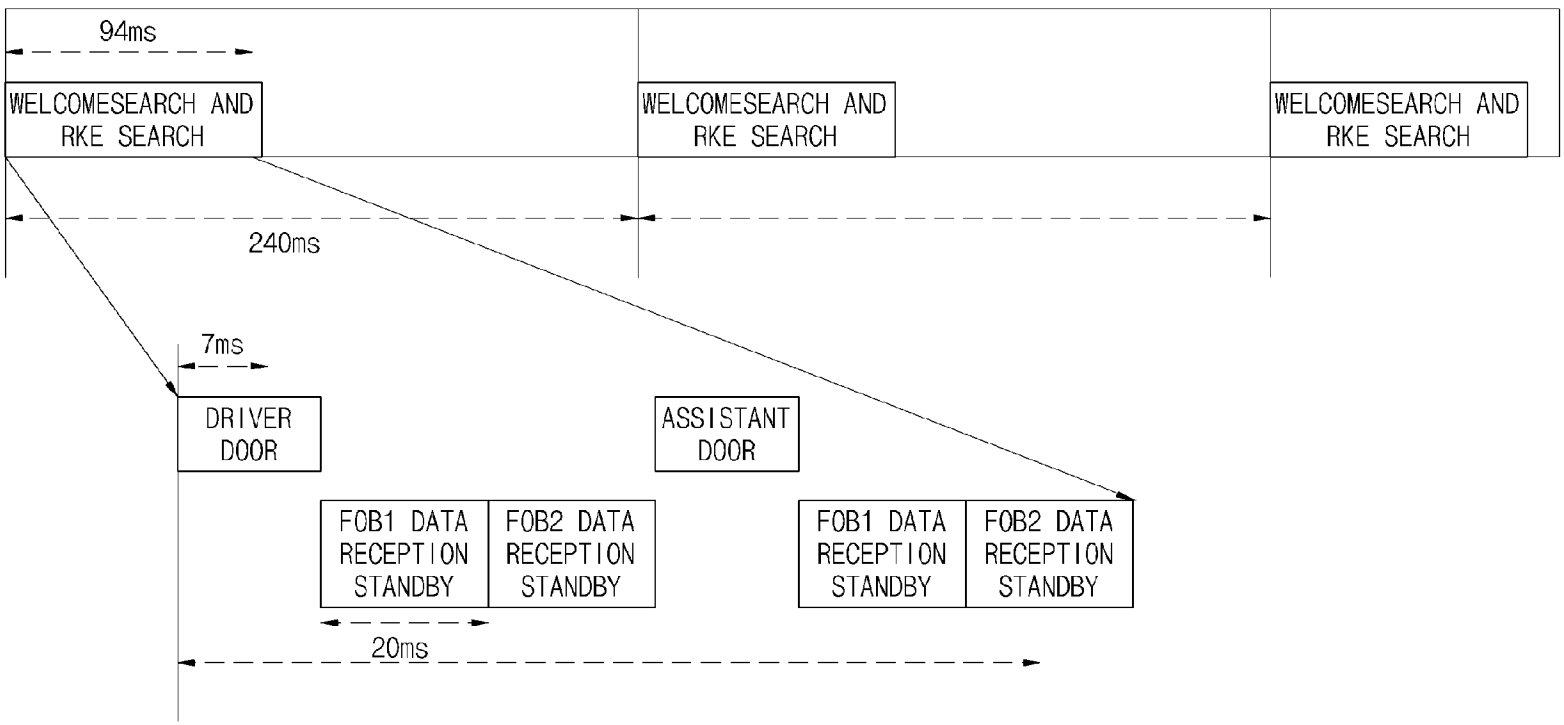
FIG. 2 is a diagram illustrating a WelcomeSearch data transmission timing in a sleep mode of the related art vehicle smartkey system.
Figure 3:
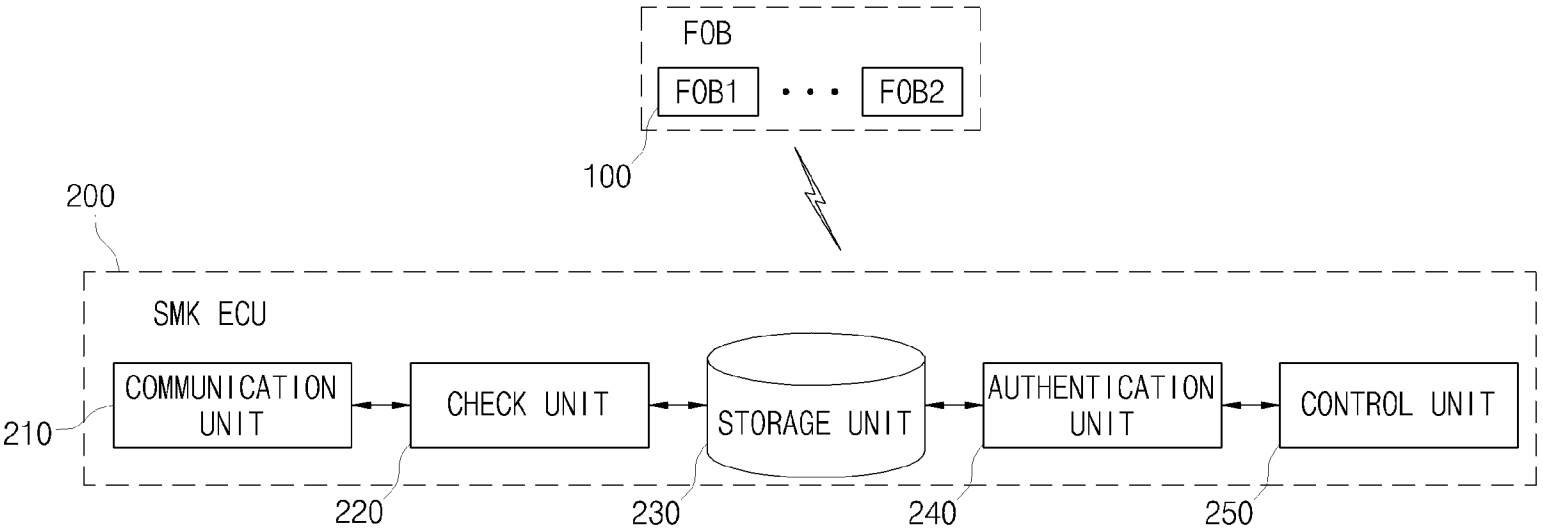
FIG. 3 is a block diagram illustrating a smartkey system for reducing battery consumption according to an embodiment of the present invention.

FIG. 3 is a block diagram illustrating a vehicle smartkey system for reducing battery consumption according to an embodiment of the present invention. Referring to FIG. 3, the vehicle smartkey system includes a fob 100 and a smartkey electronic control unit (SMK ECU) 200.

The fob 100 wirelessly performs operations, such as an operation of unlocking a door of a vehicle, an operation of locking the door, and an operation of starting the vehicle, etc., at a position near the vehicle, and is generally called a smartkey. The fob 100 receives an LF signal from the SMK ECU 200, and determines whether unique identifier information, which is learned and stored in the fob 100, matches unique identifier information included in the LF signal received from the SMK ECU 200. When the learned unique identifier information matches the received unique identifier information, the fob 100 transmits an RF signal, which is a response to the LF signal, to the SMK ECU 200.

The SMK ECU 200 controls an overall operation of the vehicle smartkey system. The SMK ECU 200 detects the fob 100 near the vehicle, and analyzes a signal received from the fob 100. When there is the fob 100 of which unique identifier matches the unique identifier of the vehicle, the SMK ECU 200 performs a driver/assistant/trunk passive access function suitable for each condition.

In order for the vehicle smartkey system to reduce battery consumption, the SMK ECU 200 includes a communication unit 210, a check unit 220, a storage unit 230, an authentication unit 240, an d a control unit 250.

The communication unit 210 includes an antenna for the vehicle smartkey system, and for example, includes a plurality of LF antennas and an RF antenna. In particular, the plurality of LF antennas include a first antenna and a second antenna. For example, the first antenna may be an LF antenna of a driver seat side, and the second antenna may be an LF antenna of an assistant seat side. As another example, the first antenna may be the LF antenna of the assistant seat side, and the second antenna may be the LF antenna of the driver seat side.

The check unit 220 wakes up at certain intervals (for example, at intervals of 240 ms) in a sleep mode of the vehicle smartkey system, and performs WelcomeSearch and RKE search. To this end, the check unit 220 transmits a fob presence check signal to near the vehicle through the communication unit 210, and determines the presence of the fob 100 near the vehicle according to whether a presence signal, which is a response to the fob presence check signal, is received through the communication unit 210. When there is no received signal, the SMK ECU 200 switches the vehicle smartkey system to the sleep mode.

The storage unit 230 stores data, and for example, temporarily stores presence signal information received through the communication unit 210. Also, the storage unit 230 may further store unique identifier information of the vehicle.

Figure 4:
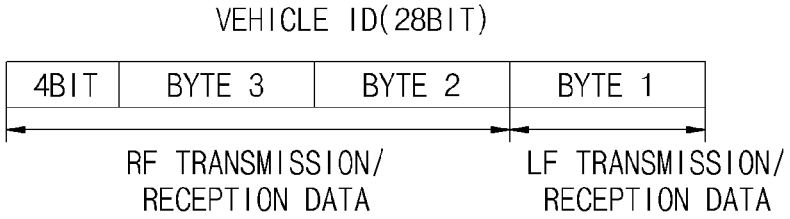
FIG. 4 is an exemplary diagram illustrating vehicle ID information that is stored in an SMK ECU and a fob according to an embodiment of the present invention.

Here, as illustrated in FIG. 4, the unique identifier information of the vehicle may be included in vehicle identification (ID) information, which may be composed of 28 bits. In the vehicle ID information, low data of 1 byte (8 bits) is an LF signal, and data of high 20 bits is an RF signal. The vehicle ID information is stored in the storage unit 230 of the SMK ECU 200 and the fob 100 that is previously registered in the SMK ECU 200 so as to enable communication with the vehicle.

The authentication unit 240 transmits an authentication information request signal to near the vehicle through the communication unit 210. When an authentication signal (which is a response to the authentication information request signal received through the communication unit 210) is received, the authentication unit 240 determines whether unique identifier information included in the received authentication information matches the stored unique identifier information of the vehicle.

When it is determined by the authentication unit 240 that there is a match therebetween, the control unit 250 releases the sleep mode of the vehicle smartkey system. Here, the release of the sleep mode is to operate a welcomelight of the vehicle, and denotes releasing the sleep mode to perform an operation such as an operation of turning on a puddle lamp, an operation of unfolding side minors of the vehicle, or the like.

Figure 5:
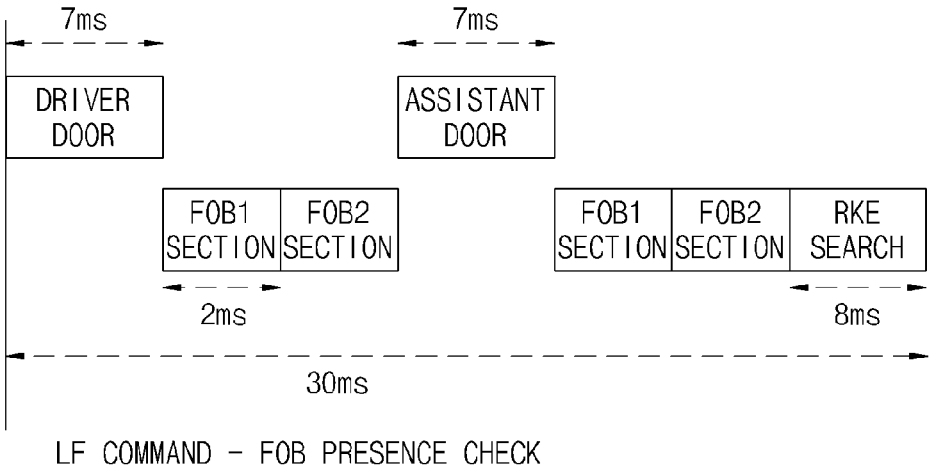
FIG. 5 is an exemplary diagram illustrating an operation of checking whether there is a fob near a vehicle according to an embodiment of the present invention.

Hereinafter, an example of an operation of the smartkey system for reducing battery consumption will be described in detail with reference to exemplary diagrams of FIGS. 5 to 7.

The check unit 220 of the SMK ECU 200 transmits the fob presence check signal to near the vehicle through the communication unit 210, and checks whether the presence signal, which is a response to the fob presence check signal, is received.

In detail, the check unit 220 transmits the fob presence check signal for a certain time (for example, 7 ms) through the first antenna (the LF antenna of the driver seat side) of the communication unit 210, and checks whether the presence signal, which is the response to the fob presence check signal, is received.

In order to check the presence signal, the SMK ECU 200 allocates a section for checking the presence signal according to the number of registered fobs, and receives a signal of a corresponding fob in only a corresponding section allocated by the SMK ECU 200. For example, when the number of registered fobs is two (a fob 1 and a fob 2), as illustrated in FIG. 5, the SMK ECU 200 allocates a fob 1 section and a fob 2 section of 2 ms, and receives only a signal of a corresponding fob in a corresponding section. The fob 100 transmits a response signal to the SMK ECU 200 in only a corresponding section. That is, the fob 1 transmits a response signal to the SMK ECU 200 in the fob 1 section, and the fob 2 transmits a response signal to the SMK ECU 200 in the fob 2 section.

During a fob presence check section (2 ms*2), the check unit 220 receives the presence signal that is the response to the fob presence check signal transmitted through the first antenna (the LF antenna of the driver seat side), and then for a certain time (7 ms), the check unit 220 transmits the fob presence check signal through the second antenna (the LF antenna of the assistant seat side) of the communication unit 210, and checks whether the presence signal, which is the response to the fob presence check signal, is received during the fob presence check section (2 ms*2).

In addition, after a fob presence reception section elapses, the SMK ECU 200 may check whether an RKE search signal is received for a certain time (8 ms). Alternatively, simultaneously with a fob presence check operation, the SMK ECU 200 may check whether the RKE search signal is received within a total time of 22 ms.

Figure 6:
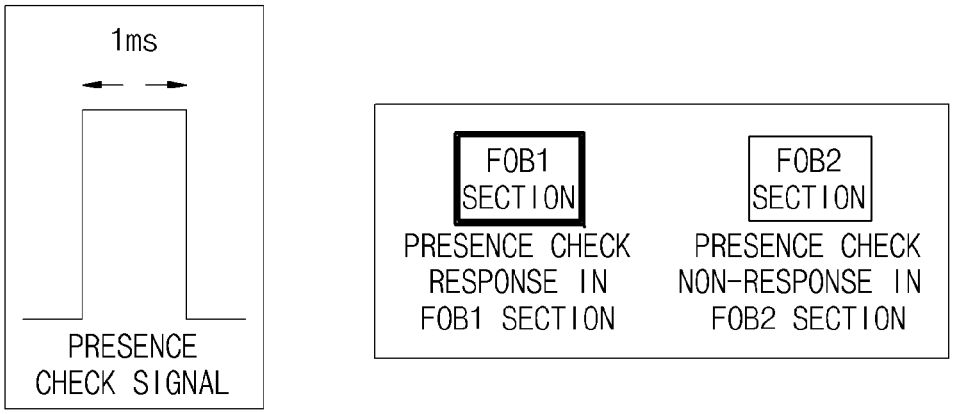
FIG. 6 is an exemplary diagram for describing a fob presence check signal for a fob near a vehicle, according to an embodiment of the present invention.

When the presence signal is received from the fob 100 near the vehicle as in FIG. 6 (*a*), the check unit 220 may determine there to be the fob 100 near the vehicle. For convenience of description, as illustrated in FIG. 6 (*b*), when the presence signal is received from the fob 100, this is illustrated as a black block, and when the presence signal is not received from the fob 100, this is illustrated as a white block.

Figure 7:
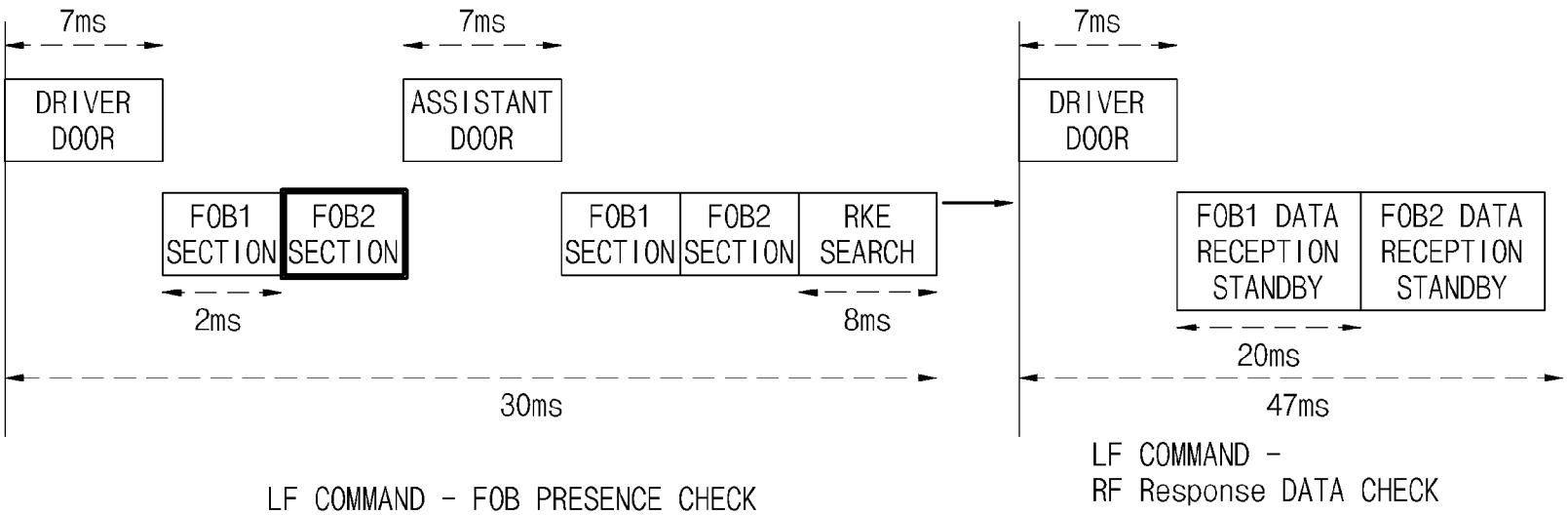
FIG. 7 is a first exemplary diagram illustrating an operation of a smartkey system for reducing battery consumption according to an embodiment of the present invention.

For example, as illustrated in FIG. 7, when the presence signal that is the response to the fob presence check signal transmitted through the first antenna (the LF antenna of the driver seat side) is received in the fob 2 section, the check unit 220 determines the fob 2 as being in a certain radius from the driver seat of the vehicle.

When the presence signal is received, the storage unit 230 may temporarily store information of the received presence signal.

As illustrated in FIG. 7, when it is checked that there are two fobs near the driver seat of the vehicle, the authentication unit 240 transmits the authentication information request signal through the first antenna (the LF antenna of the driver seat side) of the communication unit 210.

The fob 100 receiving the authentication information request signal transmits authentication information of high 20 bits in the vehicle ID of FIG. 4 to the SMK ECU 200 in its own signal transmission section.

The authentication unit 240 determines whether the vehicle unique identifier information included in the received authentication information matches the stored unique identifier information of the vehicle. This is because authentication information of a fob, which does not match the vehicle unique identifier information, is capable of being received.

When a fob (the fob 2) transmitting the authentication information is determined as a fob registered in the vehicle because there is a match between the unique identifier information, the control unit 250 releases the sleep mode of the vehicle smartkey system.

Figure 8:
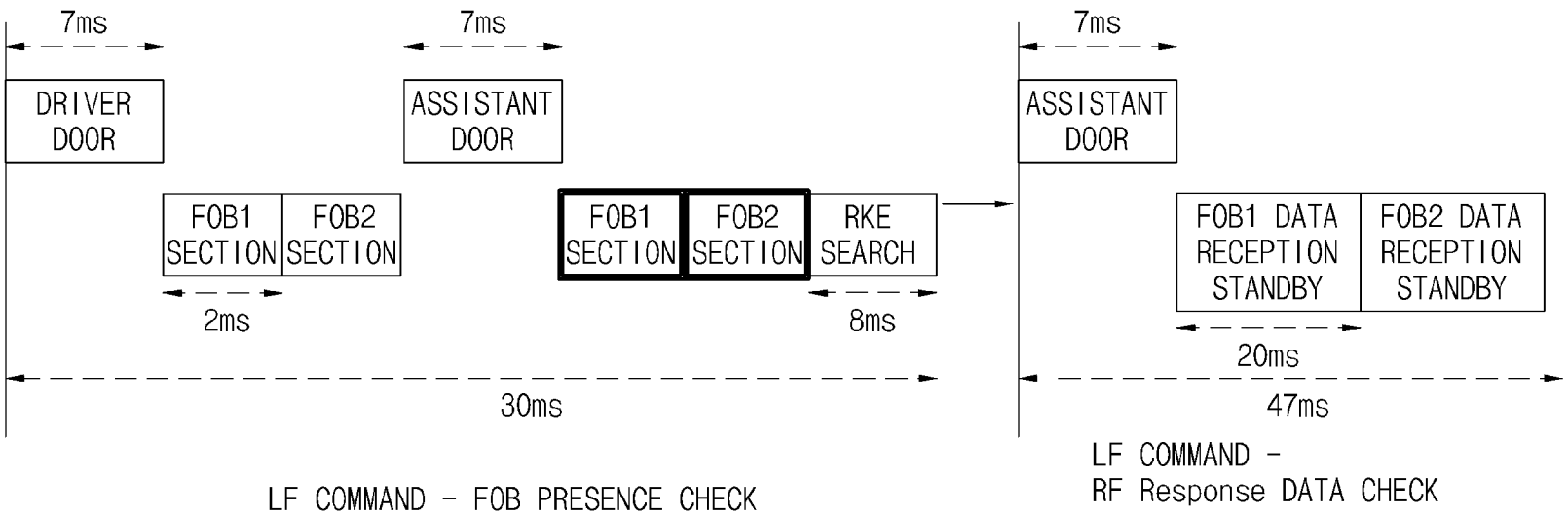
FIG. 8 is a second exemplary diagram illustrating an operation of a smartkey system for reducing battery consumption according to an embodiment of the present invention.

As another example, as illustrated in FIG. 8, when the presence signal that is the response to the fob presence check signal transmitted through the second antenna (the LF antenna of the assistant seat side) is received in the fob 1 section and the fob 2 section, the check unit 220 determines the fob 1 and the fob 2 as being in a certain radius from the assistant seat of the vehicle.

When the fob 1 and the fob 2 are determined as being near the assistant seat of the vehicle, as illustrated in FIG. 8, the authentication unit 240 transmits the authentication information request signal through the second antenna (the LF antenna of the assistant seat side) of the communication unit 210.

Figure 9:
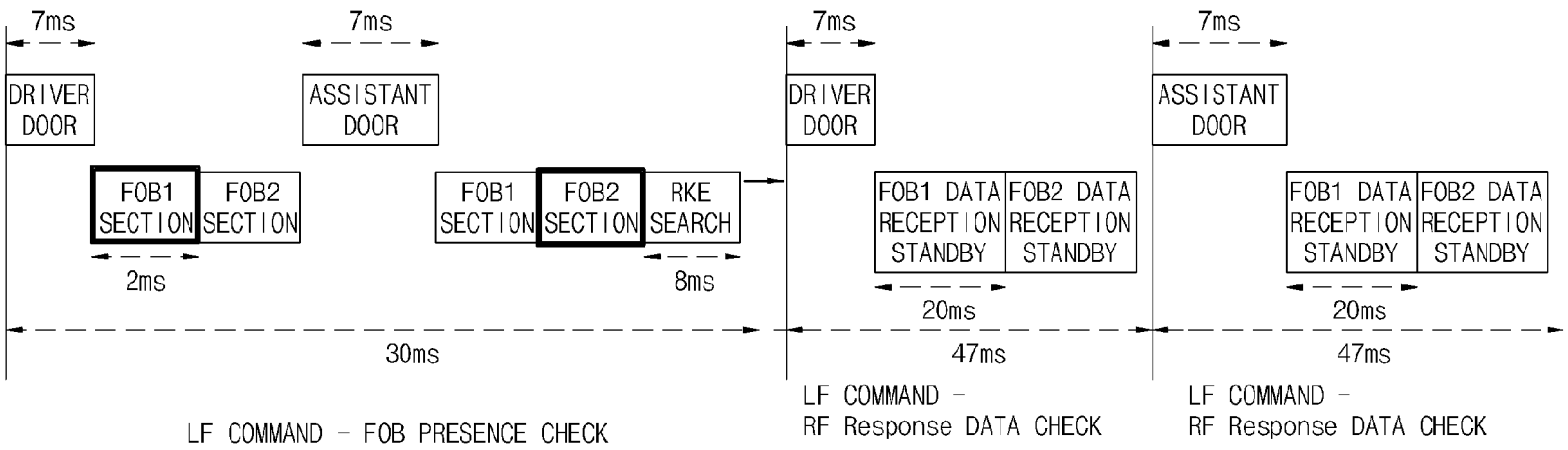
FIG. 9 is a third exemplary diagram illustrating an operation of a smartkey system for reducing battery consumption according to an embodiment of the present invention.

As another example, as illustrated in FIG. 9, when the presence signal that is the response to the fob presence check signal transmitted through the first antenna (the LF antenna of the driver seat side) is received in the fob 1 section and the presence signal that is the response to the fob presence check signal transmitted through the second antenna (the LF antenna of the assistant seat side) is received in the fob 2 section, the check unit 220 determines the fob 1 as being in a certain radius from the assistant seat of the vehicle, and determines the fob 2 as being in a certain radius from the driver seat of the vehicle.

As illustrated in FIG. 9, when it is determined that the fob 1 is near the assistant seat of the vehicle and the fob 2 is near the driver seat of the vehicle, the authentication unit 240 transmits the authentication information request signal through the first antenna (the LF antenna of the driver seat side) of the communication unit 210.

Subsequently, when authentication information that is a response to the authentication information request signal transmitted through the first antenna (the LF antenna of the driver seat side) is received, the authentication unit 240 checks unique identifier information included in the received authentication information. When it is determined that the stored unique identifier information matches the unique identifier information included in the authentication information received by the authentication unit 240, the control unit 250 releases the sleep mode of the vehicle smartkey system, and the authentication unit 240 does not perform an operation of transmitting the authentication information request signal through the second antenna (the LF antenna of the assistant seat side).

For example, when the authentication information that is the response to the authentication information request signal transmitted through the first antenna (the LF antenna of the driver seat side) is received, or although the authentication information is received, the unique identifier information included in the received authentication information does not match the stored unique identifier information, the authentication unit 240 performs an operation of transmitting the authentication information request signal through the second antenna (the LF antenna of the assistant seat side) and receiving an authentication signal that is a response thereto.

Figure 10:
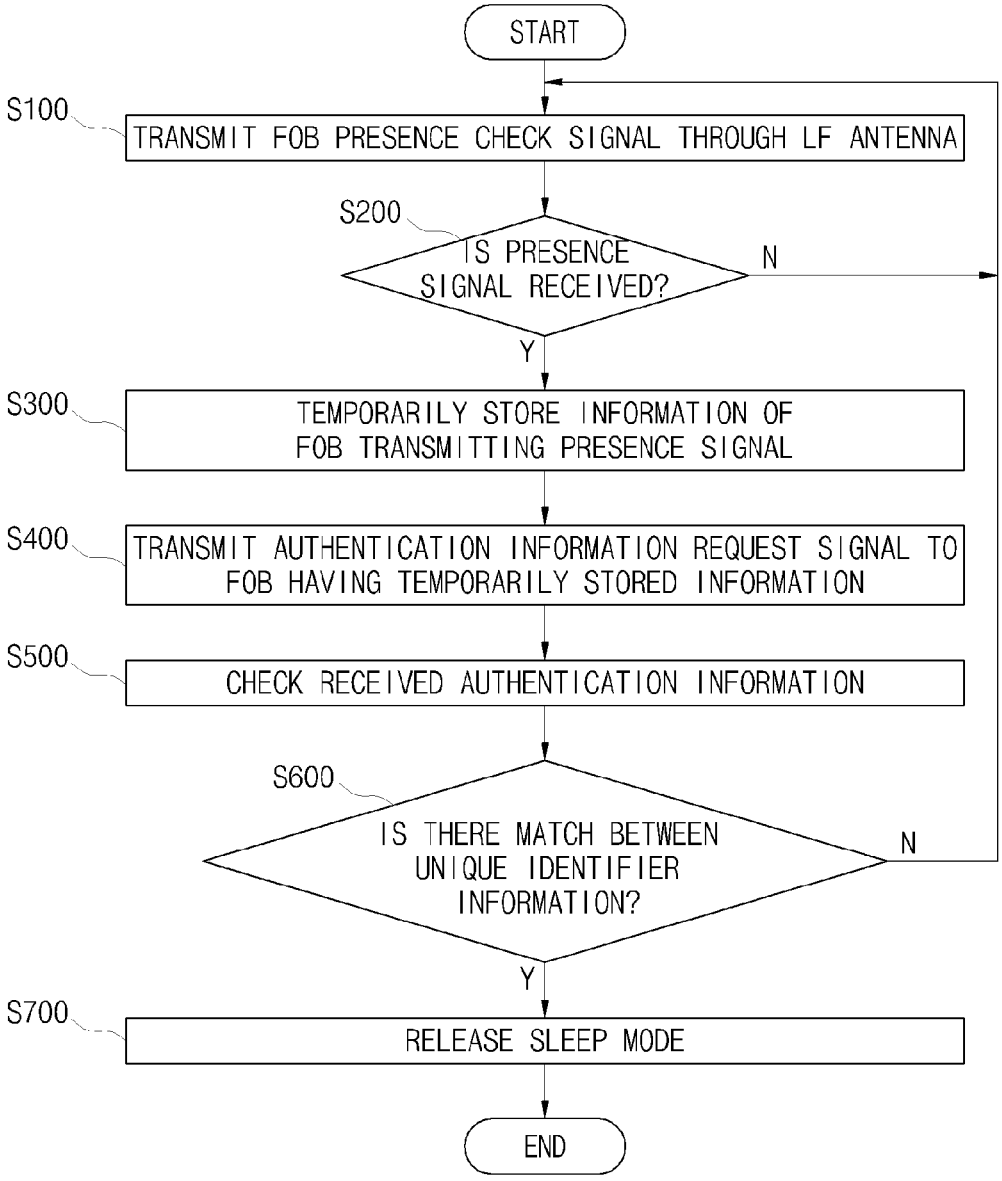
FIG. 10 is a flowchart illustrating a battery consumption reducing method of the smartkey system according to an embodiment of the present invention.

FIG. 10 is a flowchart illustrating a battery consumption reducing method of the smartkey system according to an embodiment of the present invention.

Figure 11:
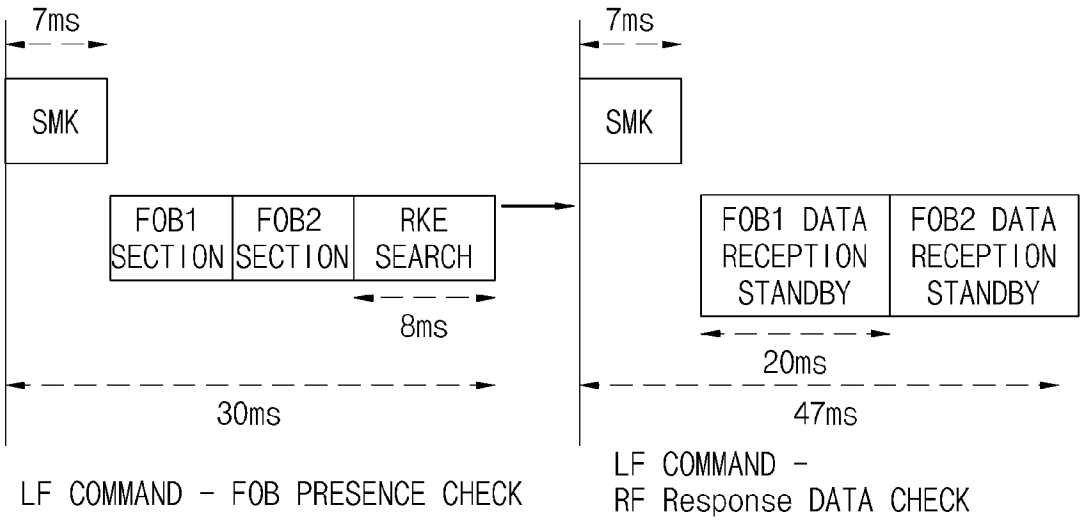
FIG. 11 is an exemplary diagram for describing the battery consumption reducing method of the smartkey system according to an embodiment of the present invention.

First, in operation S100, the SMK ECU 200 transmits the fob presence check signal through the LF antenna among the plurality of antennas for the vehicle smartkey system, for determining whether the fob 100 is near the vehicle. For example, as illustrated in FIG. 11, the SMK ECU 200 may transmit the fob presence check signal in a section of 7 ms.

Moreover, the fob presence check signal may include the unique identifier information of the vehicle, and as illustrated in FIG. 4, the fob presence check signal may be information of low 8 bits in the vehicle ID information.

The fob 100 receiving the fob presence check signal determines whether unique identifier information included in the received fob presence check signal matches unique identifier information that is learned by the fob 100 and stored, and when there is a match therebetween, the fob 100 transmits the presence signal that is the response to the fob presence check signal. Here, the presence signal may be an RF signal, and the SMK ECU 200 may receive the presence signal through the RF antenna among the plurality of antennas for the vehicle smartkey system.

Subsequently, in operation S200, the SMK ECU 200 determines whether the presence signal that is the response to the fob presence check signal is received from the fob 100. In detail, the SMK ECU 200 includes information about the number of registered fobs of which unique identifier information matches the unique identifier information of the vehicle. For example, when the number of registered fobs of which unique identifier information matches the unique identifier information of the vehicle is two, as illustrated in FIG. 11, the SMK ECU 200 determines whether the presence signal is received from the fob 100 for a certain time (2 ms*2), for receiving the presence signal from the two fobs 100. Receiving signals of a plurality of fobs in each section is for preventing interference between the signals respectively received from the plurality of fobs.

In consideration of whether the presence signal is received, the SMK ECU 200 may check whether the fob 100 is near the vehicle, and then perform an RKE search operation for a certain time (8 m). Alternatively, the SMK ECU 200 may perform the RKE search operation while checking whether the fob 100 is near the vehicle.

When the presence signal is received in operation S200, the SMK ECU 200 temporarily stores information of the fob 100 transmitting the presence signal in operation S300. Here, the stored fob information may be unique number information of the fob 100.

For example, when the presence signal is not received in operation S200, the SMK ECU 200 continuously maintains the sleep mode of the vehicle smartkey system, and after a certain time elapses, the SMK ECU 200 returns to operation S100, and performs an operation of checking whether the fob 100 is near the vehicle.

When information of the fob 100 is temporarily stored in operation S300, the SMK ECU 200 transmits the authentication information request signal to the fob 100 having the temporarily stored information through the LF antenna among the plurality of antennas for the vehicle smartkey system in operation S400. Here, as illustrated in FIG. 3, the authentication information request signal may include unique identifier information of low 8 bits in the vehicle ID information.

The fob 100 receiving the authentication information request signal from the SMK ECU 200 determines whether the unique identifier information included in the received authentication information request signal matches the unique identifier information of the fob 100, and when there is a match therebetween, the SMK ECU 200 transmits authentication information, which is a response to the authentication information request signal, to the SMK ECU 200. Here, as illustrated in FIG. 4, the authentication information that is the response to the authentication information request signal may include unique identifier information of high 20 bits in the vehicle ID information.

The SMK ECU 200 checks the authentication information received from the fob 100, and when unique identifier information included in the received authentication information matches the unique identifier information of the SMK ECU 200, the SMK ECU 200 releases the sleep mode of the vehicle smartkey system in operations S500 and S600.

In detail, when the number of registered fobs is two (the fob 1 and the fob 2), as illustrated in FIG. 11, in order to receive authentication information, the SMK ECU 200 receives authentication information of the fob 1 for a certain time (20 ms), and then receives authentication information of the fob 2 for a certain time (20 ms).

At this time, the SMK ECU 200 checks the authentication information of the fob 1, and when it is determined that unique identifier information included in the authentication information of the fob 1 matches the unique identifier information of the SMK ECU 200, the SMK ECU 200 releases the sleep mode of the vehicle smartkey system without receiving the authentication information of the fob 2.

Here, the release of the sleep mode is to operate the welcomelight of the vehicle, and denotes releasing the sleep mode to perform an operation such as an operation of turning on a puddle lamp, an operation of unfolding side minors of the vehicle, or the like.

For example, the SMK ECU 200 checks the authentication information of the fob 1, and when it is determined that unique identifier information included in the authentication information of the fob 1 matches the unique identifier information of the SMK ECU 200, the SMK ECU 200 receives the authentication information of the fob 2 to determine whether unique identifier information included in the authentication information of the fob 2 matches the unique identifier information of the SMK ECU 200.

According to the present invention, the vehicle smartkey system in the sleep mode wakes up at every certain interval, and first checks whether there is a fob near a vehicle. Only when there is the fob near the vehicle, the vehicle smartkey system receives authentication information from the fob to authenticate the fob. Therefore, an authentication operation is not performed when there is no fob near the vehicle, and thus, a wakeup time is shortened, thereby reducing an amount of dark current consumed by the vehicle.

Moreover, the wakeup time of the vehicle smartkey system is shortened, thus securing a time margin that enables an additional operation to be performed in the sleep mode.

Figure 12:
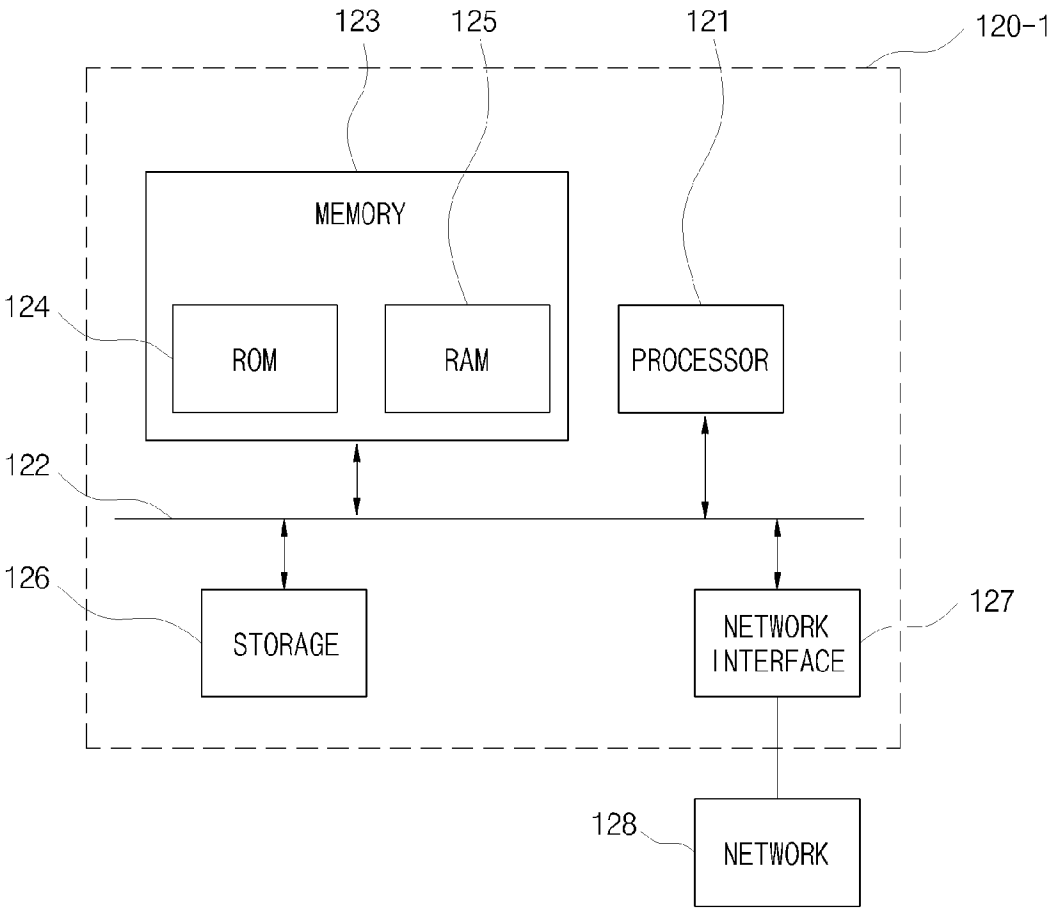
FIG. 12 is a block diagram illustrating a computer system for implementing the smartkey system.

An embodiment of the present invention may be implemented in a computer system, e.g., as a computer readable medium. As shown in FIG. 12, a computer system 120-1 may include one or more of a processor 121, a memory 123, and a storage 126, each of which communicates through a bus 122. The computer system 120-1 may also include a network interface 127 that is coupled to a network. The processor 121 may be a central processing unit (CPU) or a semiconductor device that executes processing instructions stored in the memory 123 and/or the storage 126. The memory 123 and the storage 126 may include various forms of volatile or non-volatile storage media. For example, the memory may include a read-only memory (ROM) 124 and a random access memory (RAM) 125.

Accordingly, an embodiment of the invention may be implemented as a computer implemented method or as a non-transitory computer readable medium with computer executable instructions stored thereon. In an embodiment, when executed by the processor, the computer readable instructions may perform a method according to at least one aspect of the invention.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A smartkey apparatus, comprising:

a communication unit;

a check unit configured to transmit a first presence check signal through a first antenna of the communication unit positioned at a passenger seat side of a vehicle and a second presence check signal through a second antenna of the communication unit positioned at a driver seat side of the vehicle, and to determine that a first fob is within a first radius from a passenger seat of the vehicle and that a second fob is within a second radius from a driver seat of the vehicle, in response to receiving in a first time section a first presence signal sent by the first fob in response to the first presence check signal and receiving in a second time section a second presence signal sent in response to the second presence check signal;

an authentication unit configured to transmit an authentication information request signal through the first antenna without transmitting the authentication information request signal through the second antenna, in response to the determination that the first fob is within the first radius of the passenger seat of the vehicle and the second fob is within the second radius of the driver seat of the vehicle, and to determine whether unique identifier information included in an authentication signal sent by the first fob in response to the authentication information request signal matches unique identifier information of the vehicle, in response to the authentication signal being received; and a control unit configured to release a sleep mode of the smartkey apparatus, in response to a determination by the authentication unit that the unique identifier information included in the authentication signal matches the unique identifier information of the vehicle, wherein the first time section is allocated to the first fob and the second time section is allocated to the second fob based on a number of registered fobs.

2. The smartkey apparatus of claim 1, further comprising a storage unit configured to temporarily store the first presence signal, in response to the first presence signal being received.

3. The smartkey apparatus of claim 2, wherein the check unit is further configured to transmit the second presence check signal through the first antenna of the communication unit, after the first presence signal is temporarily stored.

4. The smartkey apparatus of claim 3, wherein the authentication unit is further configured to transmit the authentication information request signal through the second antenna, in response to the unique identifier information not matching the unique identifier information of the vehicle.

5. The smartkey apparatus of claim 3 wherein the communication unit comprises a radio frequency (RF) antenna, the first antenna is an LF antenna, and the second antenna is an LF antenna.

6. The smartkey apparatus of claim 1, wherein the first presence check signal, the second presence check signal, and the authentication information request signal are low frequency (LF) signals, and the first presence signal, the second presence signal, and the authentication signal are radio frequency (RF) signals.

7. The smartkey apparatus of claim 1, wherein the control unit is further configured to turn on a puddle lamp of the vehicle or to unfold side mirrors of the vehicle, in response to the releasing of the sleep mode of the smartkey apparatus.

8. The smartkey apparatus of claim 1, wherein the first presence check signal, the second presence check signal, and the authentication information request signal comprise bits of vehicle identification (ID) information, and the authentication signal comprises other bits of the vehicle ID information.

9. The smartkey apparatus of claim 1, wherein the check unit is further configured to wake up the vehicle smartkey apparatus at intervals.

10. The smartkey apparatus of claim 1, wherein the check unit is further configured to check presence of the first fob according to whether the first presence signal is received from the first fob exclusively in the first time section.

11. A method for reducing battery consumption of a vehicle, the method comprising:

allocating a first time section to a first fob and a second time section to a second fob based on a number of registered fobs;

determining that the first fob is within a first radius from a passenger seat of the vehicle and that the second fob is within a second radius from a driver seat of the vehicle, in response to receiving in the first time section a first presence signal sent by the first fob in response to a first presence check signal transmitted through a first antenna positioned on a passenger seat side of the vehicle and receiving in the second time section a second presence signal sent in response to a second presence check signal transmitted through a second antenna positioned on a driver seat side of the vehicle;

transmitting an authentication information request signal through the first antenna without transmitting the authentication information request signal through the second antenna, in response to the determining that the first fob is within the first radius of the passenger seat of the vehicle and the second fob is within the second radius of the driver seat of the vehicle;

determining whether unique identifier information included in an authentication signal sent by the first fob in response to the authentication information request signal matches unique identifier information of the vehicle, in response to the authentication signal being received; and releasing a sleep mode of a smartkey apparatus including the first antenna and the second antenna, in response to a determination that the unique identifier information included in the authentication signal matches the unique identifier information of the vehicle.

12. The method of claim 11, wherein the first presence check signal, the second presence check signal, and the authentication information request signal are low frequency (LF) signals, and the first presence signal, the second presence signal, and the authentication signal are radio frequency (RF) signals.

13. The method of claim 11, wherein the releasing of the sleep mode comprises turning on a puddle lamp of the vehicle or unfolding side mirrors of the vehicle.

14. The method of claim 11, wherein the determining comprises temporarily storing information of the first fob, in response to the first presence signal being received, and transmitting the second presence check signal through the second antenna after the information is temporarily stored.

15. The method of claim 14, further comprising transmitting the authentication information request signal through the second antenna, in response to the unique identifier information not matching the unique identifier information of the vehicle.

16. The method of claim 14, wherein the first antenna is a low frequency (LF) antenna, and the second antenna is an LF antenna.

17. The method of claim 11, further comprising determining whether the first presence signal is received based on whether the first presence signal is received from the first fob exclusively in the first section.

18. The method of claim 11, further comprising switching the vehicle smartkey apparatus to the sleep mode, in response to not receiving the first presence check signal.

* * * * *